US006426324B1

(12) United States Patent
Lai et al.

(10) Patent No.: US 6,426,324 B1
(45) Date of Patent: Jul. 30, 2002

(54) LUBRICANT COMPOSITION

(75) Inventors: John Ta-Yuan Lai, Broadview Heights; Deborah S. Filla, Twinsburg, both of OH (US)

(73) Assignees: Noveon IP Holdings Corp., Brecksville, OH (US); BP Exploration & Oil, Inc., Chicago, IL (US)

( * ) Notice: Subject to any disclaimer, the term of this patent is extended or adjusted under 35 U.S.C. 154(b) by 0 days.

(21) Appl. No.: 09/696,617

(22) Filed: Oct. 25, 2000

Related U.S. Application Data

(63) Continuation-in-part of application No. 08/166,851, filed on Dec. 15, 1993, now abandoned.

(51) Int. Cl.[7] ..... C10M 133/12; C07C 211/55; C07C 211/57

(52) U.S. Cl. ..... 508/563; 508/543; 252/401; 564/308; 564/429; 564/433; 564/434

(58) Field of Search ..... 508/543, 563; 252/401; 564/308, 429, 433, 434

(56) References Cited

U.S. PATENT DOCUMENTS

| | | | | |
|---|---|---|---|---|
| 3,206,405 A | | 9/1965 | Hepplewhite et al. | |
| 3,247,111 A | | 4/1966 | Oberright et al. | |
| 3,492,233 A | * | 1/1970 | Hepplewhite | 508/454 |
| 3,509,214 A | * | 4/1970 | Braid | 564/308 |
| 3,573,206 A | * | 3/1971 | Braid | 508/495 |
| 3,655,559 A | | 4/1972 | Holt | |
| 3,660,290 A | | 5/1972 | Schlobohm | |
| 3,759,996 A | | 9/1973 | Braid | |
| 3,773,665 A | * | 11/1973 | Braid | 508/184 |
| 3,804,762 A | | 4/1974 | Jervis et al. | |
| 5,489,711 A | * | 2/1996 | Lai | 564/434 |

OTHER PUBLICATIONS

"Fate of Amine Antioxidants During Thermal Oxidative Ageing of Neopentypolyl Ester Oils", *Journal of Synthetic Lubrication*, 4, pp. 179–201 (1987), Loaf Coppin Pub., Ltd.: Kent, England

* cited by examiner

*Primary Examiner*—Cephia D. Toomer
(74) *Attorney, Agent, or Firm*—Olson & Hierl, Ltd.

(57) ABSTRACT

An antioxidant composition suitable for ester fluid lubricants is the reaction product of diphenylamine and N-aryl naphthylamine in the presence of an organic peroxide. The mole ratio of diphenylamine:N-aryl naphthylamine is about 1:1 to about 10:1. This results in more oligomeric reaction products and significantly less unreacted monomeric residual reactants. The resultant product composition comprises DPA homo-oligomers and DPA-NPA cross oligomers. The diphenylamine and N-aryl naphthylamine are desirably substituted with alkyl groups having from 1 to 20 carbon atoms or styryl groups. The reaction temperature is preferably about 130° to about 150° C. Controlled reaction conditions allow the use of solvents with extractable hydrogen atoms without producing significant amounts of dehydrocondensation between the solvent and the diamines. The reaction products have superior oxidative resistance in the Oxidation Corrosion Stability Test (OCS) and Vapor Phase Coker Test over dehydrocondensation products produced under other conditions and are useful in lubricant composition, especially in synthetic ester fluid lubricants such as turbine engine oils.

33 Claims, 6 Drawing Sheets

LUBRICANT COMPOSITION

CROSS-REFERENCE TO RELATED APPLICATIONS

This application is a continuation in part of U.S. Ser. No. 08/166,851 filed Dec. 15, 1993, now abandoned.

FIELD OF INVENTION

The present invention relates to an antioxidant composition for lubricants, especially for synthetic ester lubricants, and to lubricants that include such an antioxidant composition. More particularly, this invention relates to a reaction product of substituted diphenylamines (DPA) and substituted N-phenyl-α (β)-naphthylamine (PNA) and its use in lubricants. By careful selection of the mole ratio of DPA-:PNA and reaction conditions, most of the DPA and PNA are converted to oligomeric products having improved properties over the starting materials.

BACKGROUND

Amine antioxidants are known, and have been widely used to improve the thermal-oxidative stability of synthetic ester lubricants used in the lubrication of moving parts operated at very high temperature, such as jet engines and hydraulic systems for military and commercial aircraft. In operation at high temperature in the presence of oxygen and catalytically active metals, the antioxidants are depleted. Oxidative oil degradation can create acidic by-products that degrade nearly metals and can form polymers which undesirably increase the viscosity of the lubricant. This oxidative degradation, in turn, can lead to oil insoluble sludge and deposits.

U.S. Pat. No. 3,655,559 discloses alkylated diphenylamines, U.S. Pat. No. 3,660,290 discloses alkylated N-aryl naphthylamines, and U.S. Pat. No. 3,804,762 discloses alkylated N-phenyl naphthylamines in combination with specific amino compounds which are useful as antioxidants for synthetic ester lubricants. U.S. Pat. No. 3,573,206 discloses reaction products from oxidation treatment of N-aryl naphthylamines and diarylamines to form homo-oligomers of PNA and cross oligomers of DPA and PNA and a high percentage of unreacted of DPA and PNA. These reactions are done in inert solvents, such as aromatic hydrocarbon or ketones, to avoid cross dehydrocondensation reactions described later.

Heretofore it has also been known that the treatment of various compounds with peroxide produces dehydrocondensation products having increased high temperature stability as antioxidants over the monomeric components. U.S. Pat. No. 3,492,233 discloses such a blend of a conventional polyester lubricating oil reacted in the presence of diaryl amines with certain organic peroxides to form dehydrocondensation products from the esters and diarylamines. These reactions require abstractable hydrogens on the polyester lubricants. U.S. Pat. No. 3,492,233 discloses a cross-dehydrocondensed product which consists of the stabilizer, such as a secondary aromatic amine or a hydroxyaromatic antioxidant, being chemically attached to the lubricating oil or other organic substances that have abstractable hydrogens under these reaction conditions. The product has increased high temperature stability over simple mixtures of the antioxidant in the oil.

U.S. Pat. No. 3,509,214 describes the high temperature air oxidation product or permanganate oxidation product from N-aryl naphthylamine or a combination thereof with diphenylamine. An article entitled "Fate of Amine Antioxidants During Thermal Oxidative Aging of Neopentylpolyol Ester Oils" in J. of Synthetic Lubrication 4:179–201 (1987) discloses that the high temperature air oxidation of diphenylamine yields as a product, a phenazine of the structure

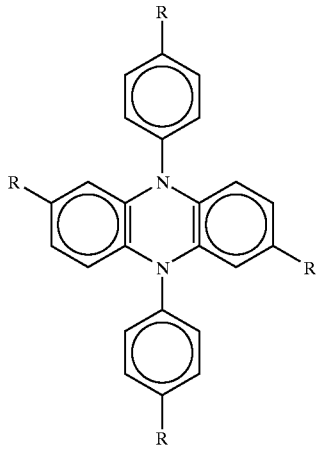

which is an insoluble sludge be avoided. As disclosed by Wieland in Chem. Ber. 39:1499–1506 (1906), the oxidation of diaryl amines with $KMnO_4$ results primarily in a dimer of the diarylamines where the nitrogen atoms are bonded together.

It has now been discovered that an amine antioxidant composition having superior high temperature stability in lubricants such as ester fluids, but which has little dehydrocondensation product, can be made by reacting controlled amounts of organic peroxides with specific molar ratios of a diphenylamine to a N-phenyl-α(β)-naphthylamine, or their alkyl substituted derivatives. These reaction products have higher concentrations of oligomer than prior art disclosures in the presence of solvents with highly abstractable hydrogens. The composition is mainly homo-oligomers of DPA and cross oligomers of DPA and PNA. When added to an ester fluid, such as used for aviation lubricants, the inventive antioxidant provides excellent protection against oxidation of the lubricant.

SUMMARY OF THE INVENTION

Effective antioxidants for lubricants are reaction products of various substituted diphenylamines (DPA), substituted N-phenyl-naphthylamines (PNA), and organic peroxides. At mole ratios of DPA:PNA of about 1:1 to about 10:1, and at temperatures of about 70 to about 200° C., primarily oligomeric products are formed from the amine molecules, which oligomeric products have enhanced performance as antioxidants over their precursors. The amount of peroxide varies from 0.5 to 3 moles per mole of total diaryl amines present. These reaction conditions were found to be critical to producing oligomers with degrees of polymerization in excess of 2, 3 or 4. Relatively low amounts of less active monomers and degradation products are associated with longer reaction times or more austere reaction conditions.

The foregoing reaction products are antioxidants and are suitable for use in lubricant compositions which comprise a major amount of an ester fluid lubricant and about 0.1 to about 10 weight percent, based on total weight of lubricant composition, of a reaction product as described above.

DETAILED DESCRIPTION OF THE INVENTION

Figure 1:
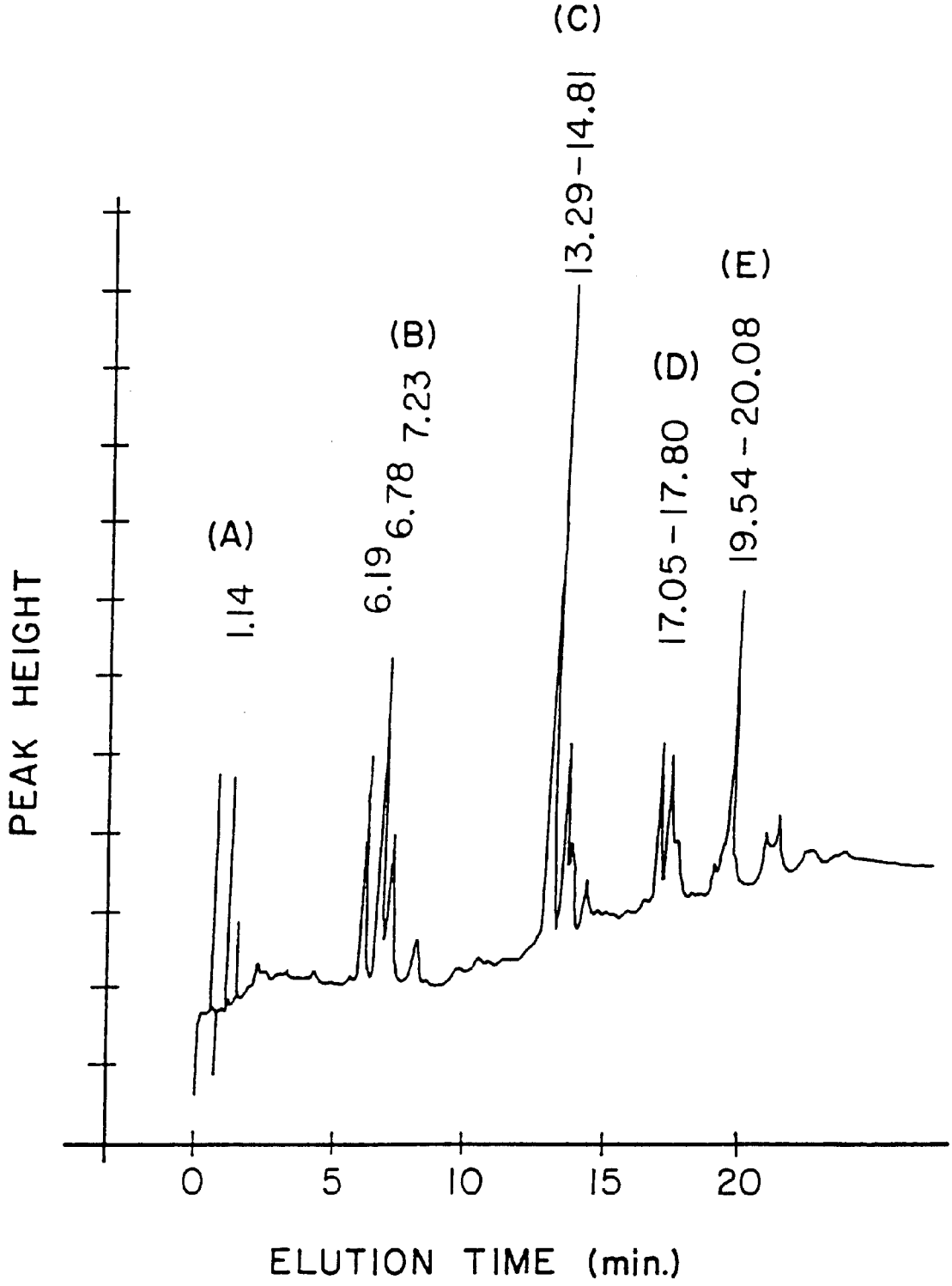
FIG. 1 shows the high performance liquid chromatography results of the product of Example 2 below; this data is summarized under Example 2 in a table format.
Figure 2:
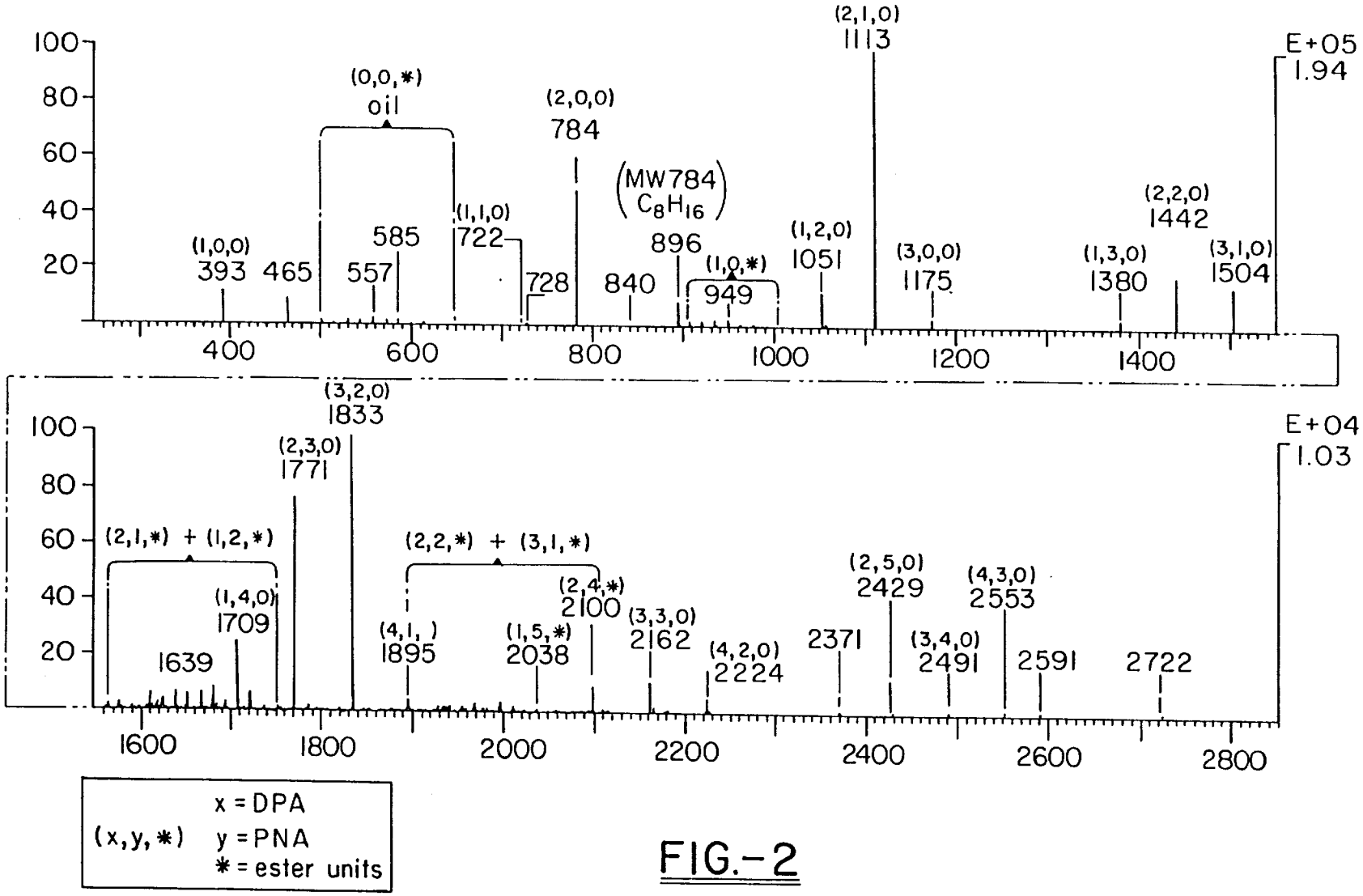
FIG. 2 shows the mass spectrum of the product of Example 2, which is the reaction product of p,p'-di-t-octyl diphenylamine (DODPA): N-(p-octylphenyl)-1-naphthylamine (OPNA) in a mole ratio of 2:1. The masses have been identified with two numbers in parentheses and are believed to be the number of units of DODPA and OPNA, respectively in the molecule that generated the mass. An asterisk (*) is used to identify peaks, including the synthetic ester fluid lubricant.

The antioxidant composition of this invention is a mixture of homo-oligomers of diphenyl amines (DPA-H) which are primarily dimers $(DPA)_2$, or their alkylated derivatives and oligomers from substituted N-phenyl-α(β)-naphthylamine (PNA-H) and substituted diphenylamine. The diphenyl amine oligomers can be represented by the following general formula

FORMULA 1

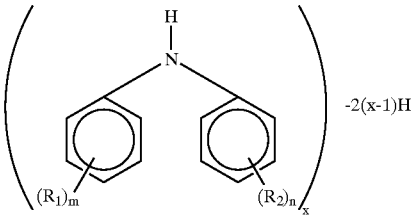

wherein each $R_1$ and $R_2$ independently are H, or branched or straight-chain $C_1$ to $C_{20}$ alkyl radicals, or radicals such as styryl or methyl substituted styryl and preferably t-butyl or t-octyl radicals; and m and n each represents 0, 1, 2, or 3; preferably m and/or n represents 1, and x is 1 to 8, preferably 2 to 5, and most preferably 2.

The cross oligomer from substituted N-phenyl-α(β)-naphthylamines with substituted diphenylamine can be represented by the following general formula

FORMULA 2

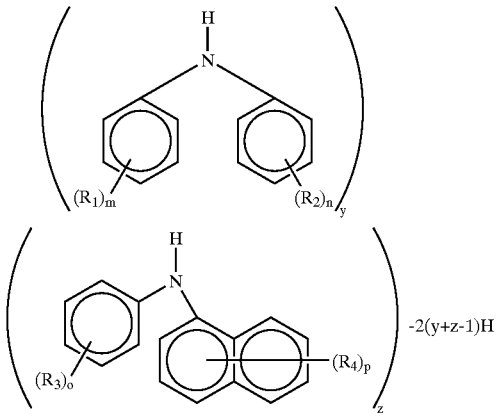

wherein y and z are integers having a value independently up to 8; preferably y is 2–5 and z is 1; wherein $R_1$ and $R_2$ are independently $C_1$ to $C_{20}$ alkyl radicals or styryl or methyl styryl, desirably $C_4$ to $C_8$ substituted radicals, and preferably t-butyl or t-octyl radicals; $R_3$ and $R_4$ are independently $C_1$ to $C_{20}$ alkyl radicals or styryl or methyl styryl, desirably $C_4$ to $C_9$ alkyl radicals and preferably t-butyl or t-octyl radicals; and m, n, p, and o are independently 0, 1, 2, or 3, and preferably one or more of m, n, o, p, and 0 are 1.

It is theorized that the bonding between the DPA and PNA may occur between two nitrogen atoms, between a nitrogen atom in one aryl-naphthylamine or diphenylamine and a carbon atom in another aryl-naphthylamine or diphenylamine, or between carbon atoms in two different aryl rings from naphthyl or phenyl radicals. It is believed that most of the linkages between the DPA and PNA molecules are between a nitrogen in one DPA or PNA and a carbon atom in naphthyl or aryl substituents of another DPA or PNA. The possible linkages are described in detail in U.S. Pat. No. 3,509,214, which is herein incorporated by reference. Formula 2 is not meant only to imply that the oligomers are block copolymers, however. The oligomers are believed to be very random in the order of DPA and PNA incorporation. The subscripts y and z are meant only to indicate the number of DPA or PNA molecules in the cross oligomer.

The antioxidant of the present invention is made by reacting diphenylamine (DPA-H), or its alkylated or styrylated derivatives, with N-phenyl-naphthylamine (PNA-H), or its alkylated or styrylated derivatives, in the presence of one or more peroxides at an elevated temperature. The reaction can be generalized as follows:

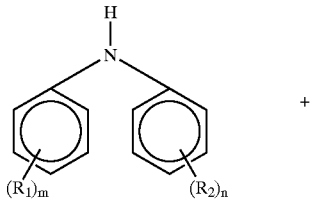

(DPA-H)

-continued

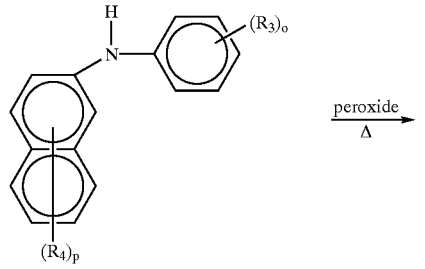

(PNA-H)

FORMULA 1

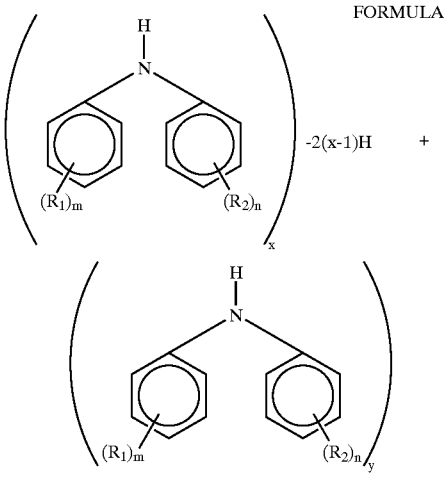

FORMULA 2

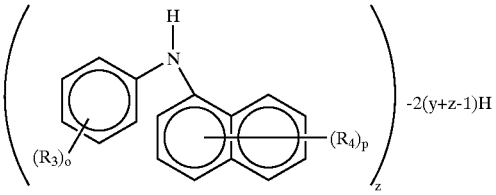

One skilled in the art will appreciate that the designation of the alkyl group within the benzene ring indicates that the alkyl group may appear at any position on the ring. Similarly, alkyl groups on the naphthylene ring may appear at any position on the ring.

In order to get high conversion of DPA and PNA to the desired oligomers, it is desirable that the DPA:PNA ratio be about 1:1 to 10:1, or about 1.2:1 to about 5:1; more desirably about 1.5:1 to about 4:1; and preferably about 1.75:1 to about 2.5:1 or 3:1; most preferably about 2:1.

The diphenylamine or its alkylated or styryl derivatives are commercially available. It has the chemical structure

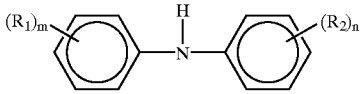

where $R_1$, $R_2$, m, and n are the same as for the diphenylamine homo-oligomers defined hereinabove. The preferred diphenylamines have tertiary alkyl groups such as octyl on each phenyl group in the para position.

The N-aryl naphthylamines and their alkylated derivatives are also commercially available. They may have the chemical structure

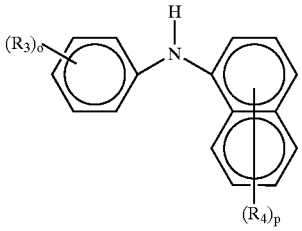

where $R_3$, $R_4$, o, and p are as defined above for the cross oligomer. Other N-aryl-naphthylamines also have substitutes of $(R_3)_o$ and $(R_4)_p$.

The reaction may be conducted in bulk or solution by heating an admixture of DPA, PNA, and an organic peroxide to temperatures desirably in the range of about 70 to about 200° C., more desirably about 90 or 110 to about 180° C., and preferably about 130 to about 150° C., and for about 30 minutes to about 30 hours, desirably about 1 hour to about 10 hours, and preferably about 2 to about 6 hours. The individual components can be added in any order, in increments, or metered into other components. The reaction may be carried out under vacuum to remove volatiles from the decomposition of the organic peroxides, if desired. The DPA and PNA may be dissolved in suitable organic solvents such as aliphatic hydrocarbons or synthetic ester lubricants, which can have abstractable hydrogens. The reaction may also be conducted in the presence of synthetic ester lubricants produced from condensation of monohydroxy alcohols and/or polyhydroxy alcohols with monocarboxylic or polycarboxylic acids. These ester fluid lubricant fluids are described in detail hereinbelow.

These ester lubricant fluids are disclosed in U.S. Pat. No. 3,492,233, and can become chemically bonded through dehydrocondensation reactions to the DPA, PNA, or oligomers thereof during the reaction of the DPA, PNA, and organic peroxides. However, with careful control of DPA to PNA ratios, the amount of peroxide used, and the reaction temperature; the amount of dehydrocondensation bond between the lubricant and amine is minimized.

Other useful solvents for the reaction of DPA, PNA, and organic peroxides are the alkane solvents having from 6 to 16 carbon atoms in a linear, branched, or cyclic structure. These are also known to form dehydrocondenstaion products with these amines, but this reaction is limited in this disclosure by the reaction conditions. These solvents are also easily removed by volatilization. The reaction may also be carried out in an alkane solvent free of peresters.

Subsequent to the reaction of the DPA, PNA, and organic peroxides, it is desirable to raise the temperature to fully decompose the organic peroxides. This minimizes undesirable oxidation reactions later. Under optimized conditions as disclosed herein, most of the desired reactions which form oligomers and cross oligomers have occurred prior to the residual peroxide decomposition step. It has been determined that no significant change in the molecular weight of the oligomers occurred during the decomposition of residual organic peroxides. Desirably, this is conducted at temperatures in the range of about 140 to about 200° C., and desirably about 160 to about 180° C., for a time period of about 5 minutes to about 2 hours, more desirably about 30 minutes to about 1 hour, and desirably at pressures below atmospheric pressure.

Reaction in accordance with the above-described conditions results in greater than 70 mole % of the DPA and PNA being in oligomeric forms of dimers or higher, desirably greater than 80 mole % in oligomeric forms of dimer or higher, more desirably greater than 90 mole % in oligomeric forms of dimer or higher, and preferably greater than 95 mole % in oligomeric forms of dimer or higher. The residual portion of the DPA and PNA is in monomer form or dehydrocondensed with solvent or other molecules present.

Any organic peroxide which has a half life of about one hour at a temperature between about 70° C. to about 200° C. may be used as a free radical source. Desirably the half-life of one hour is at temperatures between 90 to 160° C., and preferably between 130 to 150° C. Included in this group are the acyl peroxides, peresters, peroxyketals, and alkyl peroxides, all of which are commercially available from Lucidol Penwalt, U.S.A, Atochem or Akzo Chemicals, Inc., by the trademarks or common names indicated. The amount of peroxide used is desirably 0.5 to 2.0 or 3.0 moles/mole of the diaryl amines and is preferably from about 1.0 to 1.5, and most preferred from 1.1. to 1.3.

Included as peroxides are acyl peroxides of the formula

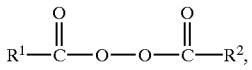

peroxyketals of the formula $$(R^1)_2C(OOR^2)_2,$$

alkyl peroxides of the formula $$R^1—O—O—R^2,$$

and peresters

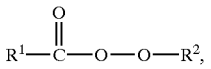

wherein $R^1$ and $R^2$ can be the same or different, and alkyl, aromatic, alkyl substituted aromatic, or aromatic substituted alkyl groups having 1 to 10 carbon atoms.

Suitable peresters include t-amylperoxy-2-ethylhexanoate, t-butylperoxy-2-ethylhexanoate (t-butyl peroctoate, t-butylperoxy-isobutyrate, t-butylperoxy-maleic acid, OO-t-butyl O-isopropyl monoperoxycarbonate, 2,5-dimethyl-1,5-di(benzoylperoxy)hexane, OO-t-butyl-O-(2-ethyl-hexyl)mono peroxycarbonate, OO-t-amyl O-(2-ethyl-hexyl)mono peroxy-carbonate, t-butyl-peroxy acetate, t-amyl-peroxy-acetate, t-butylperoxy benzoate, t-amyl-peroxybenzoate and di-t-butyl-diperoxyphthalate.

Suitable peroxyketals include n-butyl-4,4-bis(t-butylperoxy)valerate, 2,2-di(t-butylperoxy)butane, ethyl-3, 3-di(t-butylperoxy)butyrate, 2,2-di(t-amylperoxy)propane and ethyl-3, -3-di(t-amylperoxy)butyrate.

Suitable dialkyl peroxides include dicumyl peroxide, 2,5-dimethyl-2,5-di(t-butylperoxy)hexane, t-butyl cumyl peroxide α-bis(t-butylperoxy) diisopropyl-benzene, di-t-butyl peroxide, di-t-amyl peroxide and 2,5-dimethyl-2,5-di(t-butylperoxy)hexyne-3. The preferred peroxide is di-t-butyl peroxide.

The reaction products are desirably essentially free or free of potassium permanganate catalysts or products of its reduction. These permanganate catalysts result in oligomeric products from diamines having reduced antioxidant effect.

The reaction products desirably have 30 mole % or less, desirably 20 mole % or less, and preferably 10 mole % or less, of the diaryl amines reacted into dehydrocondenstation products with any solvent used for making the reaction products. Desirably the reaction products have at least 10 mole %, more desirably about 15 to 30 mole %, and preferably 20–25 mole % of the diaryl amines in the form of homo-oligomers of DPA. Desirably at least 35 mole %, more desirably 40 mole %, and preferably at least 50 mole % of the diaryl amines are in the form of cross oligomers of DPA and PNA. Desirably the reaction product contains less than 30 weight percent of DPA and PNA in monomeric form and more desirably less than 20 or 10 weight percent.

The antioxidants of this invention are useful in ester fluids including lubricating oils, fuels, hydraulic fluids, transmission fluids, especially those ester fluids useful in high temperature avionic (turbine engine oils) applications and/or internal combustion reciprocating or rotary engine oils. The antioxidants are also useful in blended oils for similar purposes that have desirably at least 10, 20, 30 or 50 weight percent ester fluids with the remainder being other lubricants such as hydrocarbon oils.

The ester fluid lubricants which may be used with this invention are esters produced from monohydroxy alcohols and monocarboxylic acids, from polyhydroxy alcohols and monocarboxlylic acids. Such esters are well known, having been described for example in U.S. Pat. No. 3,432,433 which is incorporated herein by reference. Each of the alcohols and acids used in preparing the ester may contain from 1 to 4 functional groups thereby producing mono-, di-, tri-, and tetraesters. Contemplated within this invention are esters of alcohols, diols, triols, and pentaerythritols, said alcohols or polyols having from 2 to 20 carbon atoms, and mono- and dicarboxylic acids having from 2 to about 20 carbon atoms and preferably 4 to 12.

The above esters may include the monoesters from octyl acetate, decyl acetate, octadecyl acetate, methyl myristate, butyl stearate, methyl oleate, and the like, and the polyesters from dibutyl phthalate, di-octyl adipate, di-2-ethylhexyl azelate, di-2-ethylhexyl sebacate, and the like.

The most preferred esters are produced from hindered or neopentyl alcohols, that is, those in which the beta carbon atom is completely substituted by other carbon atoms. These esters have the structure

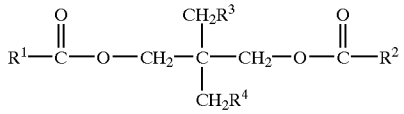

wherein each of $R^1$ and $R^2$ is individually an alkyl or aryl of 1 to 19 carbon atoms and each of $R^3$ and $R^4$ is individually hydrogen, alkyl of 1 to 5 carbon atoms or

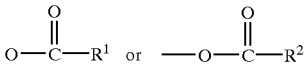

and each of the $R^1$ and $R^2$ groups are as described above. Such esters include 2,2-dimethylpropane-1,3-diol dipelargonate, trimethylolpropane trioctanoate, trimethylolpropane tridecanoate, trimethylolbutane trihexanoate, pentaerythritol tetraoctanoate and pentaerythritol tetradodecanoate. Mixtures of acids may be used in producing the di-, tri- and tetraesters. For example, a preferred pentaerythritol ester contains a mixture of $C_4$ through $C_{10}$ carboxylic acids. The esters in accordance with this invention include any ester fluid having an abstractable hydrogen atom, although the preferred reaction conditions result in minimal dehydrocondensation between the polyesters and the amines.

The antioxidant composition made as described hereinabove can be utilized in a lubricant at concentrations in the range of about 0.1 to about 10 wt.-%, desirably about 0.5 to about 5 wt.-%, and preferably about 1.5 to about 2.0 wt.-%, based upon the total weight of the lubricant composition. These amounts are of the DPA, PNA, and oligomers thereof, and do not include the synthetic ester lubricants if such lubricants are used as a solvent for the reaction. In the case of synthetic ester lubricants coreacted with DPA and PNA, the weight percentages recited above are the calculated weight percentages of DPA and PNA reactants in the final lubricant product. The antioxidant composition can be used in a lubricant composition in conjunction with other additives such as detergents, other antioxidants, corrosion inhibitors, antifoamants, antiwear additives, extreme pressure additives, hydrolytic stability agents, load additives, or viscosity modifiers, and the like. One such antioxidant can be the DPA monomer or oligomers as previously described.

The following non-limiting examples illustrate the invention and provide a more detailed understanding of the invention.

EXAMPLES

Example 1 (Comparison with 1:1 DODPA:OPNA)

p,p'-Di-t-octyl diphenylamine (DODPA) (393 g, 1 mole), N-p-octylphenyl)-1-naphthylamine (OPNA) (331.5 g, 1 mole) and decane (1 liter) were placed in a 5-liter, 3-neck flask equipped with a thermometer, an addition funnel and a distillation column. The mixture was heated to 140° C. under nitrogen and di-t-butyl peroxide (439 g, 3 moles) was added in portions. The reaction continued for 3 hours during which time t-butyl alcohol was collected through the distillation column. The reaction temperature was then raised to 170° C. for 1 hour. More t-butyl alcohol was collected. Vacuum was then slowly applied to accelerate the distillation until 2 mm Hg was reached. Residue alcohol and decane were removed under vacuum. The vacuum was released under nitrogen and the mixture was poured into a cold container. The brittle solid produced was then ground into yellow power.

Example 2 (2:1 DODPA:OPNA)

p,p'-Di-t-octyl diphenylamine (DODPA) (783 g, 2 mole), N-(p-octylphenyl)-1-naphthylamine (OPNA) (331.5 g, 1 mole) and an ester mixture consisting of a mixed $C_4$–$C_9$ acid pentaerythritol ester (1114.5 g) were placed in a 5-liter 3-neck flask equipped with a thermometer, an addition funnel and a distillation column. The mixture was heated to 140° C. under nitrogen. Di-t-butyl peroxide (526.3 g, 3.6 moles) was added in portions over 45 minutes. The reaction was continued for 3 hours during which time t-butyl alcohol was collected through the distillation column with a head temperature of 80–85° C. The color went from a fluorescent bluish color to a brown color. The reaction temperature was then raised to 170° C. over a 1-hour period and was maintained there for 40 minutes. More t-butyl alcohol was collected. The vacuum was then slowly applied to accelerate the distillation until a pressure of 2 mm Hg was reached. The reaction product was held under those conditions 20 minutes to remove all residue alcohol. The vacuum was released under nitrogen and the mixture was cooled down. The reaction product was then collected as a 50% active antioxidant in the lubricant.

High performance liquid chromatography (HPLC) results shown in FIG. 1 are based on peak area percentages determined with a 270 nm U.V. detector as follows:

Peak Areas From FIG. 1, Example 2.

X,Y=unit of DODPA is homo and cross oligomers respectively;

Z=unit of OPNA;

subscripts indicate number of units in oligomer

| | Elution Time | COMPOSITION | | | PEAK AREA |
|---|---|---|---|---|---|
| PEAK | (min) | Formula 1 | | Formula 2 | % |
| A | 1.14 | $X_1$ | | | 4.0 |
| B | 6.19–7.23 | $X_2$ | | | 21.0 |
| C | 13.29–14.81 | $X_3$ | + | $Y_2Z_1$ | 32.9 |
| D | 17.05–17.80 | | | $Y_3Z_1 + Y_2Z_2$ | 13.0 |
| E | 19.54–20.08 | | | $Y_4Z_1 + Y_3Z_2 + Y_2Z_3$ | 9.2 |

*At the 270 nm wavelength used, the peak areas are close to the weight percent of each component in the sample. For the peaks C, D, and E, the naass spectrum indicates the cross oligomers with excess DODPA over OPNA units predominate over those with more than one OPNA unit. Dehydrocondensation products between the ester and the diaryl amines were less than or equal to 15%.

Figure 3:
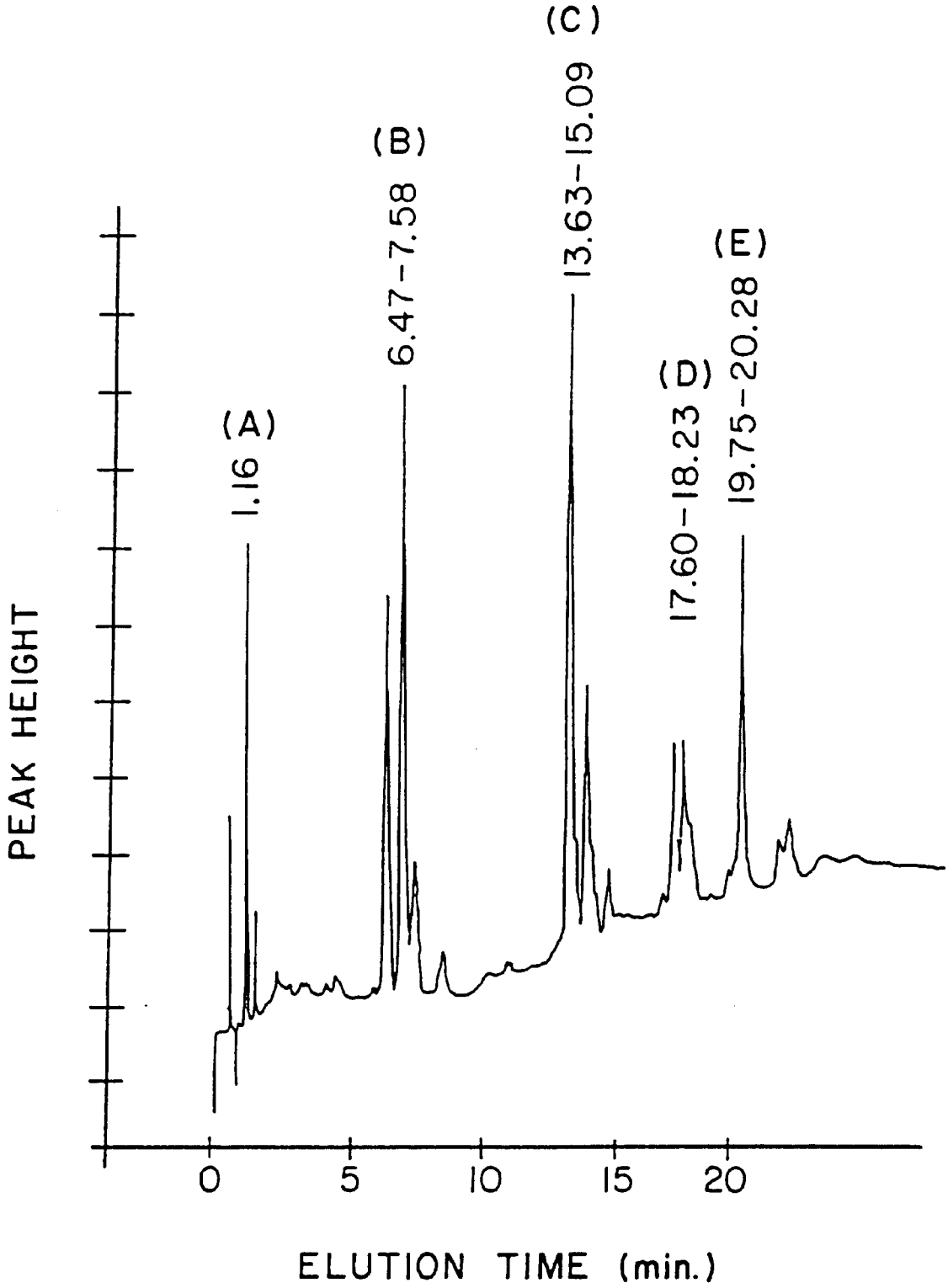
FIG. 3 shows the chromatography results of the product of Example 3; this data is summarized under Example 3 in a table format.
Figure 4:
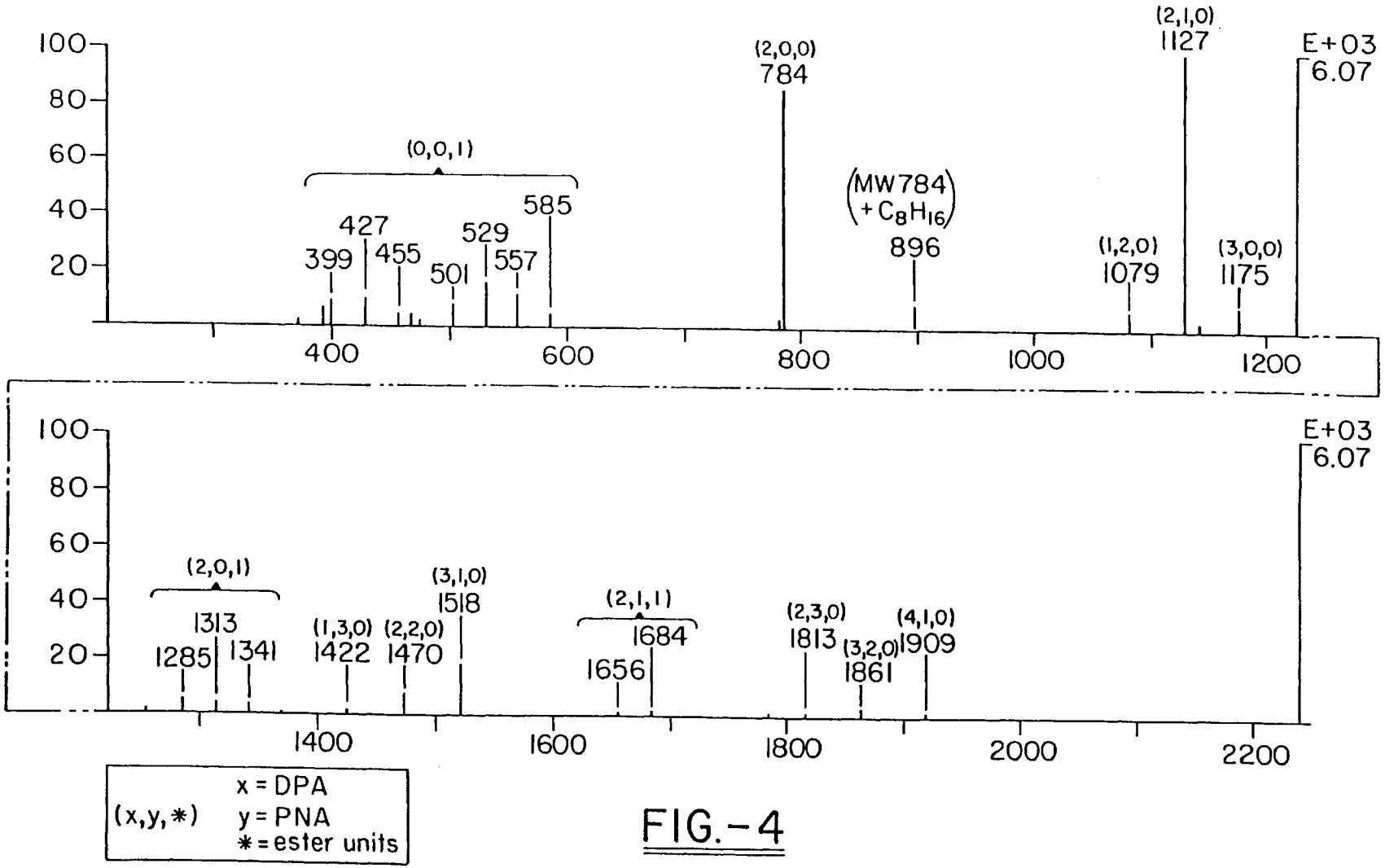
FIG. 4 shows the mass spectrum of the components in Example 3, which has a ODOPA:OPNA ratios of 3:1. The masses have been identified with three numbers in parentheses, the first # represents the number of DODPA units, the second # represents the number of OPNA units, and the asterisk (*) represents the number of ester lubricant units.

Example 3 (3:1 DODPA:OPNA)

p,p'-Di-t-octyl diphenylamine (23.6 g, 0.06 mole), N-(p-octylphenyl)-1-naphthylamine (6.63 g, 0.02 mole) were mixed with a mixed ester lubricant (30.2 g) in a 250 ml 3-neck round bottom flask equipped with a thermometer, addition funnel and magnetic stirrer. While heating to 140° C. under nitrogen, t-butyl peroxide (14.04 g, 0.096 mole) was added in portions during a half-hour period. The reaction was stirred at 140° C. for a total of 7 hours, then at 170° C. for 45 min. Vacuum (2 mm Hg) was applied at the end for 20 min. at 170° C. High performance liquid chromatography results shown in FIG. 3 are based on peak area percentages determined with a 270 nm U.V. detector as follows:

Peak Areas From FIG. 3, Example 3.

X,Y=unit of DODPA is homo and cross oligomers respectively;

Z=unit of OPNA;

subscripts indicate number of units in oligomer

| | Elution Time | COMPOSITION | | | PEAK AREA |
|---|---|---|---|---|---|
| PEAK | (min) | Formula 1 | | Formula 2 | % |
| A | 1.16 | $X_1$ | | | 3.5 |
| B | 6.47–7.58 | $X_2$ | | | 25.4 |
| C | 13.63–15.09 | $X_3$ | + | $Y_2Z_1$ | 29.1 |
| D | 17.60–18.23 | | | $Y_3Z_1 + Y_2Z_2$ | 11.1 |
| E | 19.75–20.28 | | | $Y_4Z_1 + Y_3Z_2 + Y_2Z_3$ | 9.0 |

*At the 270 nm wavelength used, the peak areas are close to the weight percent of each component in the sample. For the peaks C, D, and E, the mass spectrum indicates the cross oligomers with excess DODPA over OPNA units predominate over those with more than one OPNA unit. Dehydrocondensation products between the ester and the diaryl amines were less than 20%.

Example 4 (4:1 DODPA:OPNA)

p,p'-Di-t-octyl diphenylamine (314.4 g, 0.8 mole), N-(p-octylphenyl)-1-naphthylamine (66.3 g, 0.2 mole) were heated with a paraffin solvent (500 ml; boiling point 179–189° C.) at 140° C. t-Butyl peroxide (175.4 g, 1.2 mole) was added over 30 min. The reaction was then stirred at 140° C. for 3 hours, then at 170° C. for 1 hour. The paraffin solvent was distilled off and the residue was cooled to a brittle solid. It can be ground into a yellow power.

Example 5

The procedure in Example 3 is used except N-(p-octylphenyl)-1-naphthylamine is replaced by 0.02 mole of N-(p-nonylphyenyl)-1-naphthylamine. An oligomeric product was produced.

Example 6

Same procedure was followed as in Example 4, except p,p'-di-t-octyl diphenylamine was replaced by p-octyl diphenylamine. An oligomeric product was produced.

Example 7

Same procedures were followed as in Example 2 except p,p'-di-t-octyl diphenylamine was replaced by a mixture containing p-p'di-butyl diphenylamine, p,p'-di-octyl diphenylamine; p-t-butyl-p'-t-octyl diphenylamine; p-t-butyl diphenylamine; p-t-octyl diphenylamine and diphenylamine. An oligomeric product was produced.

Example 8

Same procedure was followed as in Example 2 except p,p'-di-t-octyl diphenylamine was replaced by a mixture of diphenylamine substituted with styryl and t-octyl groups. An oligomeric product was produced.

Oxidation Corrosion Stability Test

Figure 5:
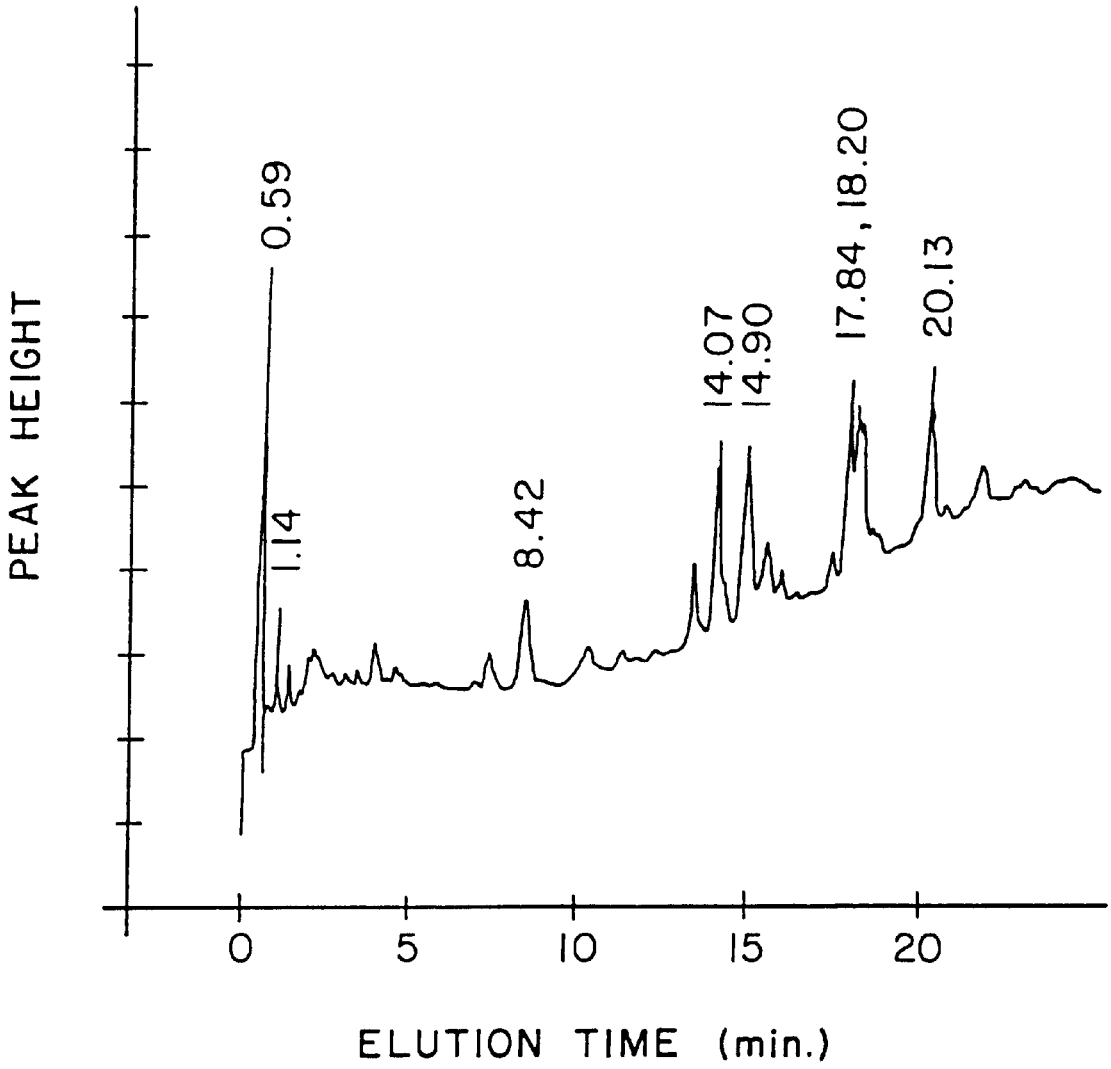
FIG. 5 shows the chromatography results on Comparison Material A, which is a commercial material with at least a 1:2 DODPA:OPNA mole ratio.
Figure 6:
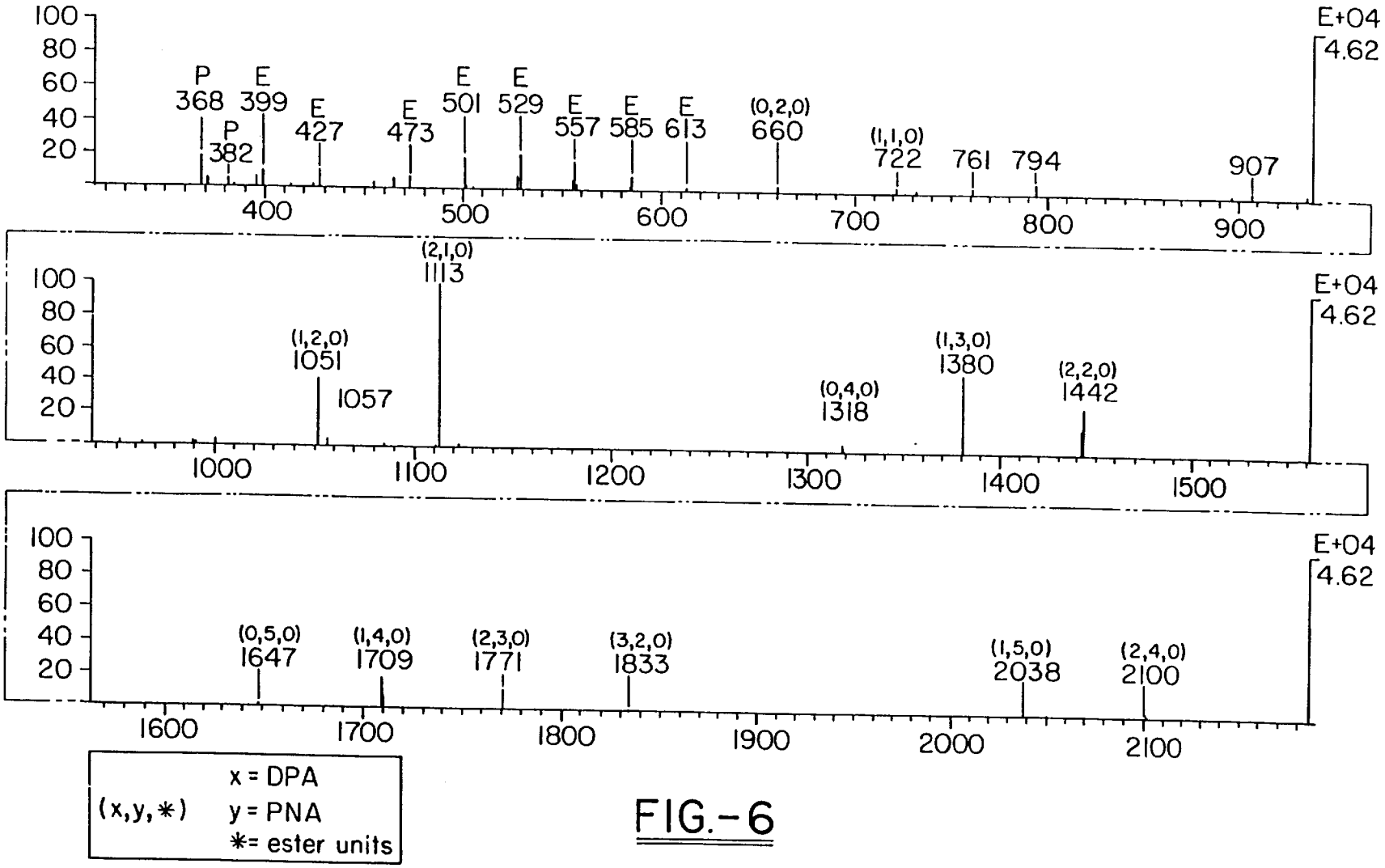
FIG. 6 shows the mass spectrum of the material of Comparison Material A which shows no trace of DODPA homo-oligomers at all. The masses have been identified in parentheses, with the first # being the number of DODPA units in the molecule and the second # being the number of OPNA units in the particular molecule, and the asterisk (*) represents the number of ester lubricant units.

The reaction products of Examples 1 and 3 were evaluated in oxidation corrosion stability (OCS) tests in the presence of various metals at different temperatures. Commercial Product A represents a commercial material made from a mixture having at least a 1:2 molar ratio of DODPA:OPNA present at 2 wt. % in an ester lubricant. High performance liquid chromatography results shown in FIG. 5 indicate that this commercial product has essentially no $(DODPA)_2$, but contains a rather complex mixture of $(DODPA)_y$ $(OPNA)_z$ where y>z dominates. The products of Examples 1 and 3 were evaluated at 2 wt. % in an ester lubricant. The OCS test is the exposure of a synthetic ester lubricant (condensation product of pentaerythritol and mixed $C_4$–$C_9$ carboxylic acid) to temperature of 400 or 425° C. for 72 hours while metals are present. It determines the ability of the antioxidants to inhibit oxidation of the lubricant and formation of acid species. It measures the change in viscosity of the lubricant at a % of the initial viscosity and the change in total acid number (ΔTAN). The viscosity is measured as kinematic viscosity at 100° F. The results in Table I, below show the change in viscosity (Δ vis %) and the change in total acid number (Δ TAN) for each example with the different metals present. The Δ TAN is calculated from the moles of additional base required to titrate or neutralize 100 g. of sample multiplied by 561.

TABLE 1

| Experiment | Measure | Example 1 | Example 3 | Commercial Material A |
|---|---|---|---|---|
| OCS 400° F. | Δ Vis % | 5.5 | 3.9 | 10.0 |
| Cu, Mg, Fe, Al, Ag | Δ TAN | 0.15 | 0.06 | 0.51 |
| OCS 425° F. | Δ Vis % | 30.5 | 13.3 | 36.0 |
| Cu, Mg, Fe, Al, Ag | Δ TAN | 5.7 | 1.99 | 4.7 |
| OCS 425° F. | Δ Vis % | 26.95 | 9.7 | 20.84 |
| Tl, Ti, Fe, Al, Ag | Δ TAN | 11.7 | 0.86 | 3.35 |
| OCS 450° F. | Δ Vis % | Not Available | 72.5 | 127.70 |

TABLE 1-continued

| Experiment | Measure | Example 1 | Example 3 | Commercial Material A |
|---|---|---|---|---|
| Cu, Mg, Fe, Al, Ag | Δ TAN | Not Available | 4.8 | 8.01 |

The data in Table I shows that the material of Example 3, using a 3:1 DODPA:OPNA ratio, a low temperature, and a controlled amount of peroxide performs better in the OCS test than the Commercial Material A, which has around a 1:2 DODPA:OPNA mole ratio and the antioxidant of Example 1, which has a 1:1 mole ratio of DODPA to OPNA. Effective antioxidants give low Δ vis % values indicating they prevent crosslinking and condensation between the molecules of the lubricant. The effectiveness of an antioxidant can also be measured by its ability to prevent the oxidation of the lubricant to carboxylic acid type species. The generation of the acid species is measured by the Δ TAN values in the OCS tests.

Example 1 has a DODPA:OPNA ratio of 1:1 which is between that of Example 3 and the Commercial Material A. The performance of Example 1 in the first two OCS tests is midway between that of Example 3 and the Commercial Material A. In the OCS test with Tl, Ti, Fe, Al, and Ag present, the Example 1 material had poor Δ Vis % and Δ TAN.

Example 9

The materials of Examples 1, 3, and Comparison Material A were also tested in the U.S. Navy Vapor Phase Coker Test. This test is fully described in publication NAPTC-PE-71 of the Naval Air Propulsion Test Center. The test is designed to simulate part of a gas turbine engine where hot surfaces are contacted by oil mists or vapors. It consists of a round bottom flask held at 400° F into which 0.027 scfm of dry air is bubbled for 18 hours. The vapor and mist formed from the bubbling air flow up into a metal tube which is in an over held at 700° F. The tube is tared before the test, and weighed afterwards to measure the mist and vapor deposit formed. A low value in this test is desirable as it indicates a lubricant with minimized tendency to form undesirable vapor/mist deposit in gas turbine engines. The average test results for the product of Example 1 were 180 mg; the test results for the product of Example 3 were 138 mg, and the test results from Commercial Material A were 295 mg. These tests indicate that an antioxidant of the invention (Example 3) produces less of the undesirable deposits during high temperature use than related antioxidants (Example 1 and Commercial Material A) which are not antioxidants of the invention.

Example 10

To study the effect of reaction conditions and DODPA:OPNA ratio on the performance of oligomeric amine reaction products, several examples from U.S. Pat. No. 3,573,206 were made replacing N-phenyl-2-naphthylamine with the more effective t-octyl N-phenyl-1-naphthylamine and replacing diphenylamine with the more effective p,p'-di-t-octyl-diphenylamine used in this application on a molar basis. Example B is from U.S. Pat. No. 3,573,206, Ex. 5, and Example C is from the same patent, Ex. 9. Both examples use the more effective alkyl substituted amines so as to be more comparable to Examples 2 and 3 presented hereinabove. Ex. B used just the OPNA, while Ex. C used on equimolar blend of DODPA and OPNA. Both used potassium permanganate to cause oxidation. As disclosed in the issued patent, the unreacted amines constituted more than 40 weight percent of the reaction products using the permanganate oxidation technology.

In Example 5 of that patent, about one-half of the reaction product was dimer of the PNA and one-half was unreacted PNA. In Example 9, about 44% of the reaction product was the diaryl amine starting materials, about 35% was the dimer of PNA, about 15% was a desirable crossoligomer, and about 5% was an unidentified side product.

The antioxidants of Examples 2, 3, and 10 (B and C) were subjected to the OCS Test at 425° F. for 72 hours. The results are given below in Table II.

TABLE II

OCS Test at 425° F., 72 Hours

| 2 Wt. % in Ester | DODPA:OPNA | Δ Vis % | Δ TAN |
|---|---|---|---|
| Example 2 | 2:1 | 18.8 | 5.65 |
| B of Example 10 | 0:1 | 41.5 | 7.15 |
| C of Example 10 | 1:1 | 41.0 | 12.4 |
| Example 3 | 3:1 | 24.3 | 4.39 |

Table II shows that the compositions of Examples 2 and 3 perform better at prevention of oxidative changes in the lubricant compositions than do Examples B and C made with permanganate oxidation. This shows that the ratio of DODPA:OPNA and the reaction conditions such as peroxides versus potassium permanganate have an observable effect on the performance of the reaction products.

Example 11

To study the effect of dehydrocondensation between the solvent and the diamines, Examples D and E were prepared. Example D was made with a mole ratio DODPA:OPNA of 1:1 in 1-decane solvent with enough t-butyl peroxide to cause greater than 90 mole % of the diaryl amines to go through dehydrocondensation with the 1-decane. Example E was made with a DODPA:OPNA mole ratio of 2:1 in a pentaerythritol ester of $C_5$–$C_9$, linear and branched fatty acids. Example E was made with t-butyl peroxide in a similar fashion as in Ex. 1 of U.S. Pat. No. 3,492,233, where about 70 mole % of the diarylamine was dehydrocondensed with the ester. Table III shows the results of using these antioxidants in oxidation stability tests.

TABLE III

OCS Test at 425° F., 72 Hours
Al, Ti, Ag, Steel Present

| | DODPA:PNA (2 Wt. %) | Δ Vis % | Δ TAN |
|---|---|---|---|
| Example 2 | 2:1 | 27.8 | 2.41 |
| D of Example 11 | 1:1 | 78.0 | 11.26 |
| E of Example 11 | 1:1 | 68.3 | 10.71 |

As can be seen from Table III, the amine antioxidants which have dehydrocondensed with the solvent (Examples D and E) are dramatically less efficient antioxidants in terms of Δ Vis % or Δ TAN.

Example E with the higher more preferred DODPA ratio produced slightly better results but was not comparable to Example 2 with the same DODPA:OPNA ratio.

Example 12

The following samples were prepared for comparison purposes by reacting DODPA and OPNA in the presence of various oxidizing agents. All reactions were carried out using the laboratory equipment and general procedures described in the prior examples.

Sample 12A—1.0 moles of DODPA were reacted with 1.0 moles of OPNA in the presence of 1.25 moles of t-butylperoxide and the $C_2$–$C_{10}$ acid pentaerithritol (Ester) of Example 2 for 2 hours 140° C. followed by 1 hour at 170° C. to remove residual peroxide. The amount of Ester employed was equal to one half of the total weight of the reaction mixture including the Ester (50% Ester). Sample 12A is a product of the invention.

Sample 12B—1.5 moles of DODPA were reacted with 1.0 moles of OPNA in the presence of 1.25 moles of t-butylperoxide and 50% Ester for 2 hours at 140° C. followed by 1 hour at 170° C. to remove residual peroxide. Sample 12B is a product of the invention.

Sample 12C—0.16 moles of DODPA and 0.08 moles of OPNA were reacted in the presence of 0.276 moles of t-butylperoxide and 50% Ester for 2 hours at 140° C. followed by 45 minutes at 170° C. to remove residual peroxide. Sample 12C is a product of the invention.

Sample 12D—1 mole of DODPA was reacted with 1 mole of OPNA in the presence of 0.5 moles $KMnO_4$ for 72 hours in the manner of Example 9 of U.S. Pat. No. 3,573,206. The resultant product was diluted with 50% Ester. Sample 12D is not a product of the invention.

Sample 12E—1 mole of DODPA was reacted with 1 mole of OPNA in the presence of 1.25 moles of $KMnO_4$ for 3 hours at 150° C. The resultant product was diluted with toluene, filtered, dried and then diluted with 50% Ester. Sample 12E is not a product of the invention.

Sample 12F—1 mole of DODPA was reacted with 1 mole of OPNA in the presence of air for 72 hours at 250° C. in a manner similar to Examples 2 and 3 of U.S. Pat. No. 3,573,206. The resultant product was diluted with 50% Ester. Sample 12F is not a product of the invention.

Sample 12G—1 mole of DODPA was reacted with 1 mole of OPNA in the presence of 30% $H_2O_2$ (1.2 moles) for 3 hours at 150° C. followed by 1 hour at 170° C. to remove residual peroxide. The resultant product was diluted with 50% Ester. Sample 12G is not a product of the invention.

Sample 12H—1 mole of DODPA was reacted with 1 mole of OPNA in the presence of 1.25 moles of m-chloroperbenzoic acid for 2 hours at 150° C. followed by 1 hour at 170° C. The resultant product was diluted with toluene, filtered, washed with 10% sodium carbonate, dried and then diluted with 50% Ester. Sample 12H is not a product of the invention.

Sample 12I—1 mole of DODPA was reacted with 1 mole of OPNA in the presence of 1.5 moles of $MnO_2$ for 4 hours at 100–140° C. The resultant product was diluted with toluene, filtered, dried and then diluted with 50% Ester. Sample 12I is not a product of the invention.

Sample 12J—1 mole of DODPA was reacted with 1 mole of OPNA in the presence of 1.25 moles of $PbO_2$ for 5 hours at 120–200° C. The resultant product was diluted with toluene, filtered, dired and then diluted with 25% Ester. Sample 12J is not a product of the invention.

Samples 12A–12J were evaluated in the OCS Test for 72 hours at 400° F. and for 72 hours at 425° F. in the presence of copper, magnesium, stainless steel, aluminum and silver. In all cases 4.0 wt. % of the Sample was added to the test synthetic ester, except 2.0 wt. % of Sample 12J was added.

The results are given below in Tables III and IV.

TABLE IV

| OCS Test Results at 400° F., 72 Hours | | | |
|---|---|---|---|
| Sample | Δ Vis % | Δ TAN | Cu Corrosion |
| 12A | 12.41 | 0.52 | −0.05 |
| 12B | 12.13 | 0.47 | −0.06 |
| 12C | 12.04 | 0.41 | −0.06 |
| 12D | 18.26 | 0.65 | −0.08 |
| 12E | 14.65 | 0.66 | −0.08 |
| 12F | 151.5 | 7.0 | −0.05 |
| 12G | 16.43 | 0.67 | −0.05 |
| 12H | 18.70 | 1.12 | −0.12 |
| 12I | 17.34 | 0.84 | −0.09 |
| 12J | 17.38 | −0.11* | −0.03 |

*Large loss of magnesium metal was noted.

TABLE V

| OCS Test Results at 425° F., 72 Hours | | | |
|---|---|---|---|
| Sample | Δ Vis % | Δ TAN | Cu Corrosion |
| 12A | 26.83 | 2.23 | 0.0 |
| 12B | 28.19 | 0.96 | 0.0 |
| 12C | 26.51 | 1.44 | 0.1 |
| 12D | 52.48 | 5.36 | 1.6 |
| 12E | 38.10 | 3.93 | 0.8 |
| 12F | 79.60 | 7.78 | 3.8 |
| 12G | 46.99 | 1.70 | 1.6 |
| 12H | 34.14 | 1.74 | 0.7 |
| 12I | 38.93 | 4.20 | 0.8 |
| 12J | 31.92 | −0.41* | 6.5 |

*Large loss of magnesium metal was noted.

The results given in Tables IV and V show that the use of organic peroxides to prepare polymeric antioxidants from diphenyl amine and aryl naphthylamine results in an improved product as compared to those materials made in the presence of other oxidizing agents.

Although the invention has been described in terms of specific embodiments of a manner the invention may be practices, this is by way of illustration only and the invention is not necessarily limited thereto since alternative embodiments and operating techniques will become apparent to those skilled in the art. Accordingly, modifications are contemplated which can be made without departing from the spirit of the described invention.

While in accordance with the Patent Statutes, the best mode and preferred embodiment has been set forth, the scope of the invention is not limited thereto, but rather by the scope of the attached claims.

We claim:

1. An antioxidant composition comprising the reaction product of:

(a) at least one N-aryl naphthylamine (PNA);

(b) at least one diphenylamine (DPA); and (c) about 0.5 to about 3 moles of an organic peroxide free radical source per mole of said PNA and said DPA; said N-aryl naphthylamine having a total of from one to six and on each aryl or naphthyl ring up to three alkyl, styryl, or methyl substituted styryl groups, or combinations thereof, wherein said alkyl has from 1 to 20 carbon atoms; said diphenylamine having a total of from one to six and on each phenyl ring up to three alkyl, styryl, or methyl substituted styryl groups, or combinations thereof, each alkyl having from 1 to 20 carbon atoms; wherein the mole ratio of said diphenylamine to said N-aryl naphthylamine is from 1:1 to 10:1, wherein the reaction of (a), (b), and (c) is conducted at temperatures from about 70° C. to about 200° C., wherein the reaction product has at least 10 mole percent of said DPA in the form of homo-oligomers of DPA, and wherein the reaction product has at least 35 mole percent of said PNA and DPA in the form of cross oligomers of DPA and PNA.

2. The antioxidant composition according to claim 1, wherein said peroxide free radical source is present in amounts from about 0.5 to about 2 moles per mole of combined moles diphenylamine and aryl naphthylamine, and wherein said mole ratio of diphenylamine to N-aryl naphthylamine is about 1.2:1 to about 5:1.

3. The antioxidant composition according to claim 2, wherein said groups on the diphenylamine are independently $C_4$ to $C_8$ alkyl radicals or styryl or methyl substituted styryl and said groups on the N-aryl naphthylamine are independently $C_4$ to $C_8$ alkyl radicals or styryl or methyl substituted styryl groups, and wherein said mole ratio of diphenylamine to N-aryl naphthylamine is from 1.5:1 to 4:1.

4. The antioxidant composition according to claim 3, wherein said at least one N-aryl naphthylamine and said at least one diphenylamine are reacted with an organic peroxide at a temperature of about 130° C. to about 150° C. to form primarily dimers and cross oligomers of said diphenylamine.

5. The antioxidant composition according to claim 4, wherein the alkyl groups on said diphenylamine and N-aryl naphthylamine are t-octyl groups.

6. The antioxidant composition according to claim 4, wherein said organic peroxide is present in amounts of about 1 to 1.5 moles per combined moles of diphenylamine and N-aryl naphthylamine.

7. The antioxidant composition according to claim 6, wherein the reaction is carried out in an alkane solvent free of peresters.

8. The antioxidant composition according to claim 4, wherein said reaction product has at least 40 mole percent of said DPA and PNA in the form of cross oligomers of DPA and PNA.

9. The antioxidant composition according to claim 4, including a solvent, wherein the product has no more than 30 mole % of said diphenylamine dehydrocondensed with the solvent.

10. In a process for making antioxidant stabilizers from one or more mono or poly (alkyl and/or styryl and/or methyl styryl) substituted N-aryl naphthylamines (PNA) and mono or poly (alkyl and/or styryl and/or methyl styryl) substituted diphenylamines (DPA), the improvement which comprises using a mole ratio of diphenylamines to N-aryl naphthylamines of about 1:1 to about 10:1 and reacting said PNA and DPA in the presence of about 0.5 to about 3 moles of a peroxide free radical source per mole of said PNA and said DPA at a temperature from about 70° to about 200° C., and producing a reaction product having at least 10 mole percent of said DPA in the form of homo-oligomers of DPA, and wherein the reaction product has at least 35 mole percent of said PNA and DPA in the form of cross oligomers of DPA and PNA.

11. The process according to claim 10, wherein said alkyl groups are $C_4$–$C_8$ alkyl groups and said styryl groups are styryl or methyl substituted styryl; wherein said mole ratio diphenylamine to N-aryl naphthylamine is about 1.5:1 to about 4:1; wherein the free radical source has a half life of one hour at a temperature from 70° C. to 200° C.

12. The process according to claim 11, wherein the reaction of said PNA and DPA is conducted in an alkane solvent, said alkane having from 6 to 16 carbon atoms.

13. The process according to claim 11, wherein the reaction of the PNA and DPA is conducted in the presence of a synthetic ester lubricant.

14. The process according to claim 11, wherein the reaction is conducted in a solvent, and wherein no more than 30 mole percent of said DPA is reacted into dehydrocondensation products with said solvent.

15. The process according to claim 14, wherein the reaction product has less than 10 wt. % of PNA and DPA in monomeric form.

16. The process according to claim 15, wherein said free radical source is present at a concentration from about 1.0 to about 1.5 moles per combined moles of DPA and PNA.

17. An antioxidant composition comprising homo-oligomers of diphenylamine and cross oligomers of diphenylamine with N-aryl naphthylamine and optionally a solvent, wherein said diphenylamine includes substituted diphenylamine having a total of from one to six and on each phenyl ring up to three, independently, alkyl, methylstyryl or styryl groups, wherein said alkyl groups have from 1 to 20 carbon atoms; wherein said N-aryl naphthylamine has a total of from one to six and on each aryl or naphthyl ring up to three, independently alkyl, methylstyryl, or styryl groups, wherein said alkyl group has from 1 to 20 carbon atoms; wherein said homo-oligomers of diphenylamine are at least 10 mole % of the total diphenylamine units; and wherein the cross oligomers have at least 40 mole % of the total diphenylamine and N-aryl naphthylamine units.

18. The antioxidant composition according to claim 17, wherein the amount of said homo-oligomers of diphenylamine are about 15 to about 30 mole % and wherein said cross oligomers are at least 50 mole %.

19. The antioxidant composition according to claim 18, wherein said alkyl groups of said diphenylamine oligomer are t-butyl or t-octyl and said alkyl groups on said N-aryl maphthylamine are t-butyl or t-octyl.

20. A lubricating fluid composition stabilized against oxidative and thermal degradation which comprises:

a) a lubricating fluid containing a synthetic ester fluid subject to thermal or oxidative degradation, and b) an effective stabilizing amount of an antioxidant composition of claim 1.

21. A composition according to claim 20, wherein the synthetic ester fluid is at least 50 weight percent of said composition.

22. A composition according to claim 20, wherein the mole ratio of diphenylamine to N-aryl naphthylamine in said reaction product antioxidant is about 1.2:1 to about 5:1; and wherein said reaction product contains at least 40 mole percent of said diphenylamines and N-aryl naphthylamines in the form of cross oligomers of DPA and PNA.

23. A lubricant composition which comprises a major amount of an ester fluid lubricant and 0.1 to 10 weight percent, based on the total weight of the lubricant composition, of an antioxidant composition comprising the reaction product of:

(a) at least one N-aryl naphthylamine wherein said N-aryl naphthylamine has up to three independent alkyl and/or styryl substituent groups on each aryl ring, wherein said alkyl has from 1 to 20 carbon atoms and said styryl is styryl or methyl substituted styryl;

(b) at least one diphenylamine wherein the phenyl groups are individually phenyl or phenyl having up to 3 alkyl or styryl substituent groups on each aryl ring, each alkyl having from 1 to 20 carbon atoms and the styryl being styryl or methyl substituted styryl; and (c) an organic peroxide free radical source; wherein the mole ratio of said diphenylamine to said N-aryl naphthylamine is about 1:1 to about 10:1, the reaction is conducted from about 70° C. to 200° C. and the reaction product comprises primarily a mixture of homo-oligomers of said diphenylamine and cross oligomers of said N-aryl naphthylamine and said diphenylamine.

24. The lubricant of claim 23 wherein the amount of the antioxidant composition is about 0.5 to about 5.0 weight percent based on the total weight of the lubricant and wherein the antioxidant composition comprises the reaction product of p,p'-di-t-octyl diphenylamine (DODPA) with N-(p-octylphenyl)-1-naphthylamine (OPNA) in a DODPA:OPNA mole ratio in the range of about 1.75:1 to about 3:1.

25. A lubricant composition which comprises a major amount of an ester fluid lubricant and 0.1 to 10 weight percent, based on the total weight of the lubricant composition, of an antioxidant composition comprising the reaction product of:

(a) at least one N-aryl naphthylamine wherein said N-aryl naphthylamine has up to three independent alkyl groups on each aryl ring, and wherein each said alkyl group has from 1 to 20 carbon atoms;

(b) at least one diphenylamine wherein the phenyl groups are individually phenyl or phenyl having up to 3 alkyl substituent groups on each phenyl ring, each alkyl having from 1 to 20 carbon atoms; and (c) an organic peroxide free radical source; wherein the mole ratio of said diphenylamine to said N-aryl naphthylamine is about 1:1 to about 10:1, the reaction is conducted from about 70° C. to 200° C. and the reaction product comprises primarily a mixture of homo-oligomers of said diphenylamine and cross oligomers of said N-aryl naphthylamine and said diphenylamine.

26. The lubricant of claim 1 wherein (i) the diphenylamine (DPA-H) is represented by the following general formula:

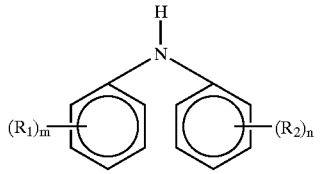

wherein each $R_1$ and $R_2$ independently are H, or branched or straight chain $C_1$–$C_{20}$ alkyl radicals and m and n each represent 0, 1, 2 or 3 and (ii) the N-aryl naphthylamine is N-phenyl naphthylamine (PNA-H) represented by the general formula:

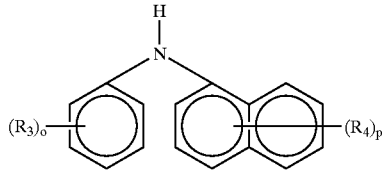

wherein $R_3$ and $R_4$ are independently $C_1$ to $C_{20}$ branched or straight chain alkyl radicals and o and p represent 0, 1, 2, or 3 and the mole ratio of (DPA-H) to (PNA-H) is from 1:1 to 10:1.

27. The lubricant of claim 26 wherein the peroxide free radical source is present in an amount of about 0.5 to about 3 moles per mole of combined DPA-H and PNA-H and wherein the mole ratio of DPA-H to PNA-H is about 1.2:1 to about 5:1.

28. The lubricant of claim 27 wherein $R_1$, $R_2$, $R_3$, and $R_4$ are independently $C_4$ to $C_8$ alkyl radicals and m, n, o and p are 1.

29. The lubricant of claim 28 wherein $R_1$, $R_2$, $R_3$, and $R_4$ are t-octyl radicals.

30. The lubricant of claim 29 wherein the molar ratio of said organic peroxide to the combined moles of DPA-H and PNA-H is about 1:1 to about 1:5 and wherein the reaction product is substantially free of permanganate.

31. The lubricant of claim 28 wherein the mole ratio of DPA-H to PNA-H is about 1.75:1 to about 3:1.

32. The lubricant of claim 31 wherein $R_1$, $R_3$ and $R_4$ are independently t-butyl or t-octyl radicals.

33. The lubricant of claim 32 wherein the reaction product is at least 30 wt % of oligomers containing at least one DPA unit and one PNA unit.

* * * * *

UNITED STATES PATENT AND TRADEMARK OFFICE

CERTIFICATE OF CORRECTION

PATENT NO. : 6,426,324 B1 
DATED : July 30, 2002
INVENTOR(S) : John Ta-Yuan Lai et al.

It is certified that error appears in the above-identified patent and that said Letters Patent is hereby corrected as shown below:

Title page,
Item [57], ABSTRACT,
Line 8, "DPA-NPA" should be -- DPA-PNA --.

Signed and Sealed this

Eleventh Day of February, 2003

JAMES E. ROGAN
*Director of the United States Patent and Trademark Office*